US009456287B2

(12) United States Patent
Lindebjerg et al.

(10) Patent No.: US 9,456,287 B2
(45) Date of Patent: Sep. 27, 2016

(54) HEARING AID COMPONENT WITH EARWAX FILTER

(71) Applicant: Oticon A/S, Smorum (DK)

(72) Inventors: Martin Lindebjerg, Smorum (DK); Dennis Presutti, Smorum (DK); Jacob Holdt Hansen, Smorum (DK)

(73) Assignee: OTICON A/S, Smorum (DK)

( * ) Notice: Subject to any disclaimer, the term of this patent is extended or adjusted under 35 U.S.C. 154(b) by 0 days.

(21) Appl. No.: 14/148,156

(22) Filed: Jan. 6, 2014

(65) Prior Publication Data

US 2014/0193012 A1 Jul. 10, 2014

Related U.S. Application Data

(60) Provisional application No. 61/749,434, filed on Jan. 7, 2013.

(30) Foreign Application Priority Data

Jan. 7, 2013 (EP) ..... 13150405

(51) Int. Cl.
*H04R 25/00* (2006.01)

(52) U.S. Cl.
CPC ..... *H04R 25/654* (2013.01); *H04R 25/608* (2013.01)

(58) Field of Classification Search
CPC ..... H04R 25/654; H04R 2460/11; H04R 2225/025; H04R 2225/77; H04R 2460/17; H04R 25/65; H04R 25/652; H04R 25/658; H04R 1/1016; H04R 1/1091; H04R 2205/041; H04R 2225/021; H04R 2225/023; H04R 25/02; H04R 25/456; H04R 25/602
USPC ..... 381/322, 328, 324, 325, 312
See application file for complete search history.

(56) References Cited

U.S. PATENT DOCUMENTS

| | | | | |
|---|---|---|---|---|
| 4,870,689 | A | 9/1989 | Weiss | |
| 4,972,488 | A | 11/1990 | Weiss et al. | |
| 5,278,360 | A | 1/1994 | Carbe et al. | |
| 5,712,918 | A * | 1/1998 | Yoest | 381/328 |

(Continued)

FOREIGN PATENT DOCUMENTS

| | | | |
|---|---|---|---|
| DE | 8913743 | U1 | 1/1990 |
| DE | 20208601 | U1 | 10/2003 |

(Continued)

*Primary Examiner* — Davetta W Goins
*Assistant Examiner* — Phylesha Dabney
(74) *Attorney, Agent, or Firm* — Birch, Stewart, Kolasch & Birch, LLP

(57) ABSTRACT

A hearing aid component with earwax filter is provided, wherein the hearing aid component has a sound inlet opening that has at least two sound inlet portions having different diameters and being displaced with respect to each other in a longitudinal direction of the sound inlet opening so that the sound inlet opening narrows towards the interior of the hearing aid component so that more proximal sound inlet portion has a relatively larger diameter and more distal sound inlet portion has a relatively smaller diameter. The earwax filter is placed in said sound inlet opening and comprises: a cap with an outward-facing and an inward-facing side, and a peripheral edge, said peripheral edge being force-fitted into the sound inlet portion with the relatively larger diameter. The cap has a plurality of sound inlets arranged along the periphery of the cap wherein the sound inlets are arranged along a perimeter of the cap.

24 Claims, 12 Drawing Sheets

(56) References Cited

U.S. PATENT DOCUMENTS

| | | | | |
|---|---|---|---|---|
| 6,795,562 | B1 | 9/2004 | Gunnersen et al. | |
| 7,130,437 | B2 * | 10/2006 | Stonikas | H04R 25/652 381/322 |
| 2004/0240694 | A1 * | 12/2004 | Wolf | 381/322 |
| 2008/0013767 | A1 * | 1/2008 | Olsen et al. | 381/328 |
| 2011/0299712 | A1 * | 12/2011 | Bondo et al. | 381/325 |

FOREIGN PATENT DOCUMENTS

| | | | |
|---|---|---|---|
| EP | 1439731 | A1 | 7/2004 |
| EP | 2393311 | A1 | 12/2011 |
| WO | 0724377 | A1 | 7/1996 |
| WO | WO 00/03561 | A1 | 1/2000 |
| WO | WO 03/067926 | A2 | 8/2003 |
| WO | WO 2012/121730 | A1 | 9/2012 |

* cited by examiner

HEARING AID COMPONENT WITH EARWAX FILTER

CROSS REFERENCE TO RELATED APPLICATIONS

This nonprovisional application claims the benefit of U.S. Provisional Application No. 61/749,434 filed on Jan. 7, 2013 and to European Patent Application No. 13150405.2 filed in Europe on Jan. 7, 2013. The entire contents of all of the above applications are hereby incorporated by reference.

The invention relates to a hearing aid component with an earwax (cerumen) filter and an earwax filter for placement in an opening of a hearing aid component.

Earwax filters are used to prevent earwax (earwax) from entering openings, such as sound openings of a hearing aid component. Typically, earwax filters are made replaceable so that a used and potentially clogged earwax filter can be replaced by a new and clean one. To do so, handling tools are provided that help in removing a used earwax filter and in inserting a new earwax filter. To allow for easy carrying of plurality of earwax filters, earwax filter dispensers are known.

Sound emitted by a hearing aid travels from a hearing aid's output transducer (receiver, loudspeaker) to a hearing aid sound outlet opening, where it has to pass the earwax filter. For the purpose of this disclosure, parts along the sound path that are closer to the receiver are called "proximal", and parts that are closer to a user's tympanic membrane (such as the earwax filter) are called "distal".

Ambient sound entering the hearing aid first passes a sound inlet opening and then travels to a pick-up transducer for converting sound waves into electric signals, e.g. a microphone. For the purpose of this disclosure, parts along the sound path that are closer to an ambient sound source are called "proximal", and parts that are closer to a hearing aid component's pick-up transducer (such as a microphone) are called "distal".

Penetration of earwax and the like tend to be a major reason to failing hearing instruments. To improve the service rate, life time and reliability of hearing instruments, a system which prevents earwax from entering the hearing instrument and reaching the transducers is essential. The system shall not influence the performance of the hearing instrument.

Prior art earwax filters and handing tools are inter alia disclosed in EP 1 439 731 B1, U.S. Pat. No. 6,795,562 B1, DE 202 08 601 U1, WO 03/067926 A3, WO 00/03561 A1, EP 0 724 377, U.S. Pat. No. 5,278,360 A, U.S. Pat. No. 4,972,488 A, DE 89 13 743 U1 and U.S. Pat. No. 4,870,689 A.

The invention aims for an effective, easy to handle earwax filter.

According to the invention, this aim is achieved by a combination of a hearing aid component with earwax filter. The hearing aid component has a sound inlet opening that has at least two sound inlet portions having different diameters and being displaced with respect to each other in a longitudinal direction of the sound inlet opening so that the sound inlet opening narrows towards the interior of the hearing aid component, resulting in that the more proximal sound inlet portion has a relatively larger diameter and the more distal sound inlet portion has a relatively smaller diameter. The earwax filter is placed in said sound inlet opening and comprises:

A cap with a an outward-facing and an inward-facing side and a peripheral edge, wherein the inward-facing side faces the hearing aid and wherein the peripheral edge is force-fitted into the sound inlet portion with the relatively larger diameter;

a stem protruding into the sound inlet portion with the relatively smaller diameter, wherein the stem has a proximal end connected to the cap, and a distal end that has a diameter that is smaller than the diameter of the sound inlet portion with the relatively smaller diameter, so that an annular gap remains between the stem and the sound inlet portion with the relatively smaller diameter, wherein the cap has a plurality of sound inlets arranged along the periphery of the cap, wherein the sound inlets are shaped so as to allow ambient sound passing into the annular gap, wherein the sound inlets are arranged along a perimeter.

The sound inlet opening of the hearing aid component can be arranged in a faceplate of the hearing aid component.

The particular shape of the sound inlet opening with its two portions with different diameters together with the sound path defined by the particular geometry of the earwax filter result in a capillary trap that prevents earwax from creeping into the sound inlet.

The capillary trap is essentially caused by the right angle between a surface of the sound inlet opening and a surface of the earwax filter. The oily substances of the earwax have a tendency to creep along capillary paths, but here the large angle between the two surfaces blocks further advance of the fluid.

Preferably, the peripheral edges are part of an outwardly facing circumferential bead that surrounds the cap and has a diameter that is larger than the perimeter of the cap along which the sound inlets are arranged. In other words: The circumferential bead radially extends beyond a circumferential side wall of the cap. According to a further preferred embodiment, the circumferential bead is recessed in the sound inlet portion with a relatively larger diameter. Thus, a small annular groove is created between a circumferential wall of the outer sound inlet portion and the circumferential outer wall of the cap.

It is preferred that the circumferential bead has an inner contact surface that contacts a radially extending wall portion of the sound inlet opening that is present between a proximal sound inlet portion with a relatively larger diameter and the distal sound inlet portion with a relatively smaller diameter. This difference in diameters results in a kind of step which leads to the radially extending wall portion of the sound inlet opening. The inner contact surface of the circumferential bead abuts the radially extending wall portion of the sound inlet opening when the earwax filter if fully inserted into the sound inlet opening. Thus, the inner contact surface of the earwax filter and the radially extending wall portion of the sound inlet define how deep the earwax filter can be inserted into the sound inlet opening.

It is further preferred when the circumferential bead has an inner circumferential wall that extends in a direction transverse to the radially extending wall portion of the sound inlet opening and defines an at least nearly a right angle between the radially extending wall portion and the inner circumferential wall. This angle is an essential feature to keep earwax from creeping further into the sound inlet opening, because this sharp angle creates a capillary trap.

Preferably, the circumferential bead is connected to the cap by axially and radially extending ribs, wherein each rib is arranged between two neighboring sound inlets.

Each rib preferably has an inner edge facing the radially extending wall portion of the sound inlet opening. It is preferred if the inner edge of each rib and the inner contact surface of the circumferential bead are offset with respect to each other so as to leave a gap between each inner edge of each rib and the radially extending wall portion of the sound inlet opening when the inner contact surface of the circumferential bead contacts the radially extending wall portion. This gap causes a widening of the sound inlets by way of some sort of undercut and further helps to prevent earwax from creeping into the sound inlet opening. Therefore, the gap is not just a marginal gap.

The number of ribs is preferably between 5 and 11, e.g. 9.

The stem of the earwax filter that extends into the more distal portion of the sound inlet opening preferably has a blind hole that is open towards the outward facing side of the cap and that is configured to receive a tip of a handling tool. Thus, a tip of a handling tool can be inserted into the blind hole for handling the earwax filter.

In order to prevent the earwax filter from falling off the handling tool during handling, a snap bead is formed on the circumferential wall of the blind hole which allows a snap-fit connection with the handling tool.

In its preferred embodiment, the earwax filter is an interchangeable unit which has small openings (sound inlets) for the sound to enter and which can be replaced when necessary. To prevent penetration of cerumen through the sound inlets the unit preferably is hydrophobic coated and the path from each sound inlet to transducer is z-shaped to complicate the eventual travel of earwax or the like. A sealing feature hinders earwax or the like from travelling at the interface between the unit and the other parts of the hearing instrument, which furthermore bring out eventual earwax or the like when the unit is removed. A secondary protection feature follow the sealing feature and take advantage of capillary forces by having a large volume after a ever small volume, hence prevent further travel of earwax or the like.

This solution is preferred due to the application of various features which work side by side to protect against earwax or the like, e.g. hydrophobic coating which rule out travel of earwax on the surfaces, z-shaped path from sound inlet to end of filter, double protection at the interface between the filter and the mounting hole, self cleaning function, and it integrated removal feature.

The wax protection filter is made up by a cylindrical shape with sound inlets positioned around the side of the cylinder, which is hydrophobic coated. The earwax filter is shaped to be mounted in a counter sunk hole of the sound inlet opening. When the earwax filter is mounted the sound inlets will be positioned so that earwax can not enter directly, the hydrophobic coating contribute to earwax not entering through the sound inlets.

Two features provide protection against earwax:

1.) An outward-facing circumferential bead defining the peripheral outer edge of the earwax filter provides a sealing between the earwax filter and the circumferential wall of the sound inlet opening. When the earwax filter is pulled out of the sound inlet opening in which it is mounted, the peripheral edge of the circumferential bead will sweep the wall circumferential of the sound inlet opening, hence bringing out eventual earwax.

2) At the interface between the earwax filter and a radially extending wall of the sound inlet opening the design takes advantage of capillary forces to keep earwax out. This is achieved by a narrow passage which ends in a much larger volume. Furthermore is the path from sound inlets to the distal end of the earwax filter, when mounted in the sound inlet opening, not direct and straight but z-shaped.

The peripheral outer edge of the outward-facing circumferential bead provides fixation of the filter through a press fit between the earwax filter and the sound inlet opening. The filter is removed using a tool with a tip which snaps onto the earwax filter at the central blind hole. This blind hole features an under-cut feature which along with the tool make up the snap functionality.

The invention shall now be described in more detail by way of example with respect to the attached Figures. In the Figures.

Figure 1:
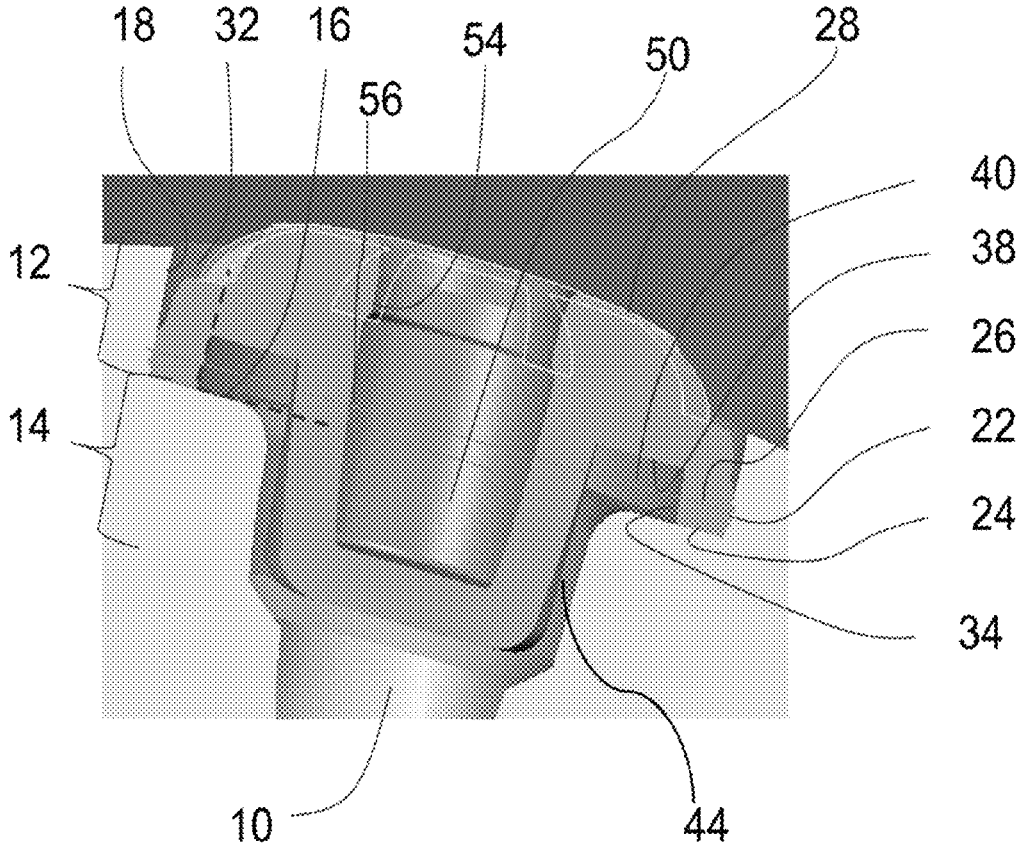
FIG. 1 is a cross-sectional view of a sound inlet opening and an earwax filter inserted therein.

As can be taken from FIG. 1, sound inlet opening 10 has a proximal (outer) portion 14 with a larger diameter and a more distal portion 14 with a smaller diameter. Between the proximal portion 12 of the sound inlet opening 10 and the distal portion 14 of the sound inlet opening 10, a radially extending wall portion 16 of the sound inlet opening exists due to the fact that the larger diameter proximal portion 12 of the sound inlet opening and the smaller diameter distal portion 14 of the sound inlet opening 10 define a step.

The earwax filter 20 inserted in sound inlet opening 10 contacts and abuts sound inlet opening 10 on a circumferential wall 18 of the proximal portion 12 of the sound inlet opening 10 and at the radially extending wall portion 16.

Thus, the earwax filter 20 has two surfaces that abut the sound inlet opening, namely a peripheral edge 22 and an inner contact surface 24 of an outward facing circumferential bead 26 that surrounds a cap 28 of earwax filter 20.

Figure 2:
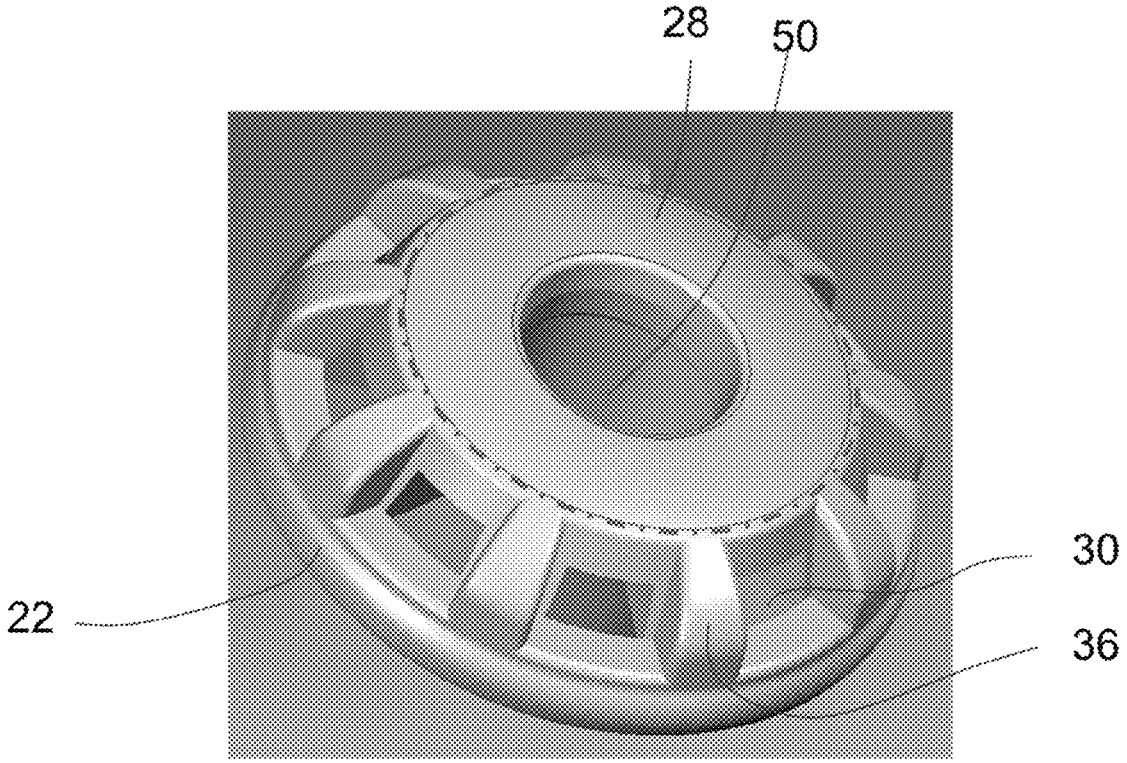
FIG. 2 is a perspective representation of the earwax filter if viewed from the outside.
Figure 3:
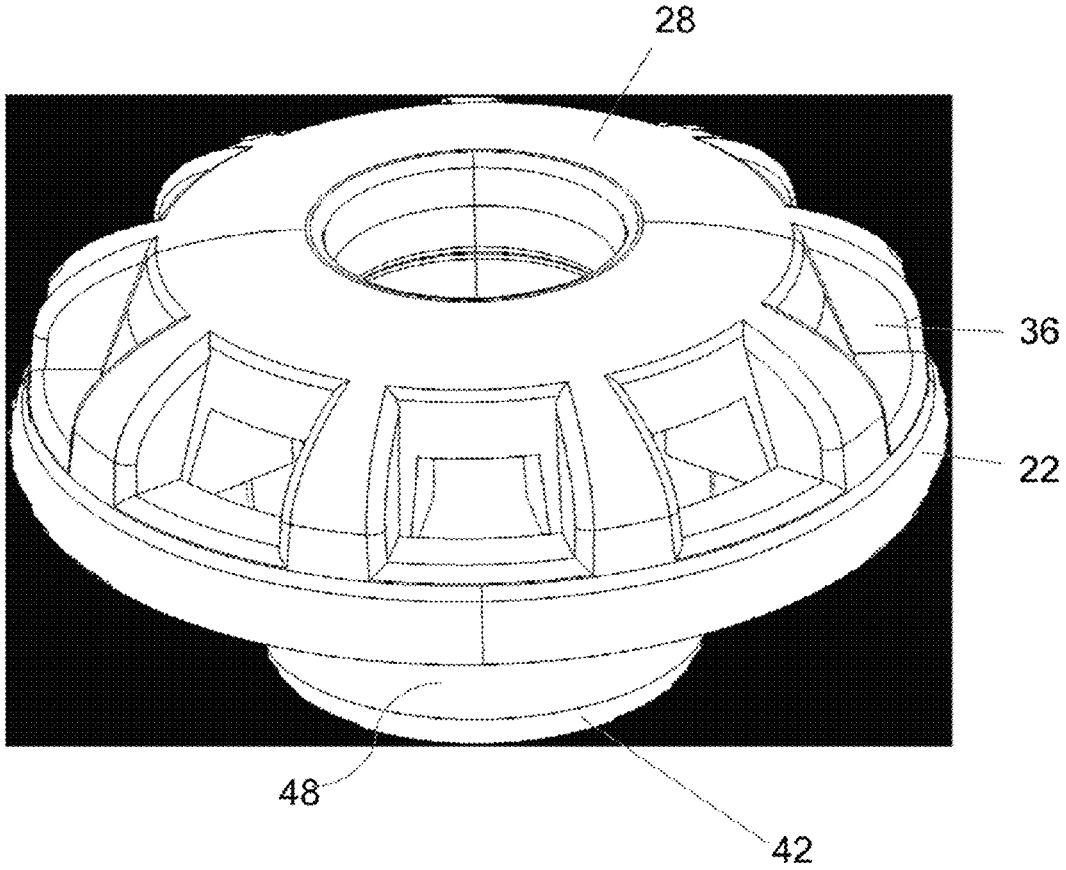
FIG. 3 is a perspective representation of the earwax filter as seen from the outside.
Figure 4:
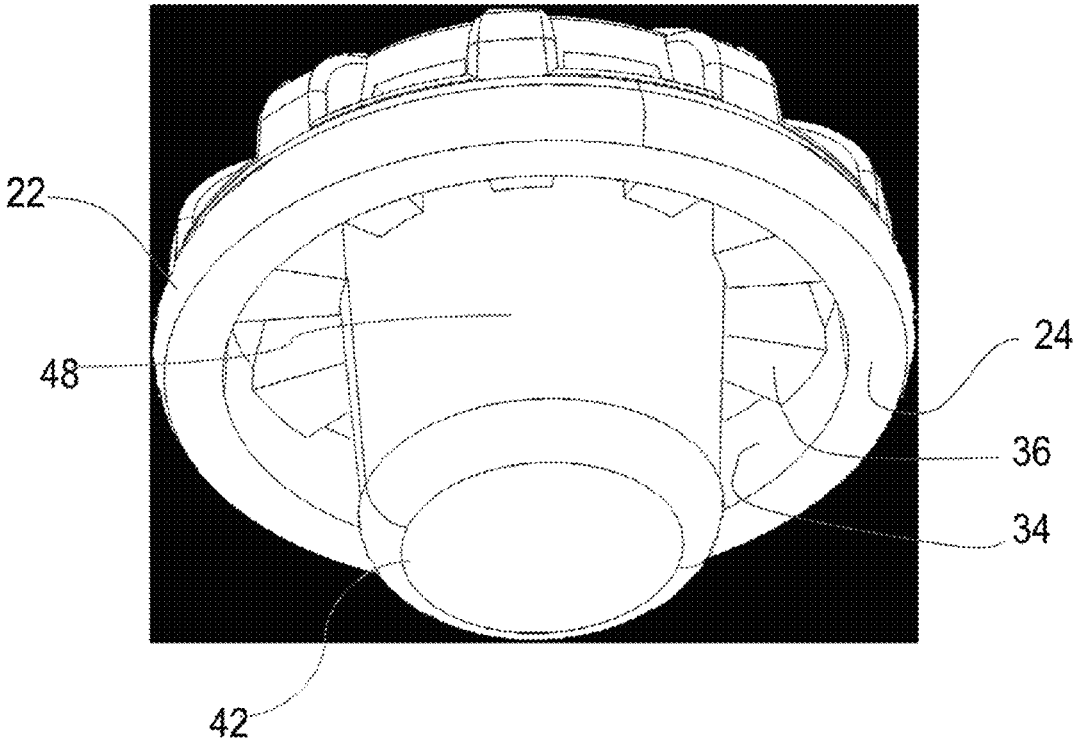
FIG. 4 is a perspective representation of the earwax filter as seen from the inner side.
Figure 5:
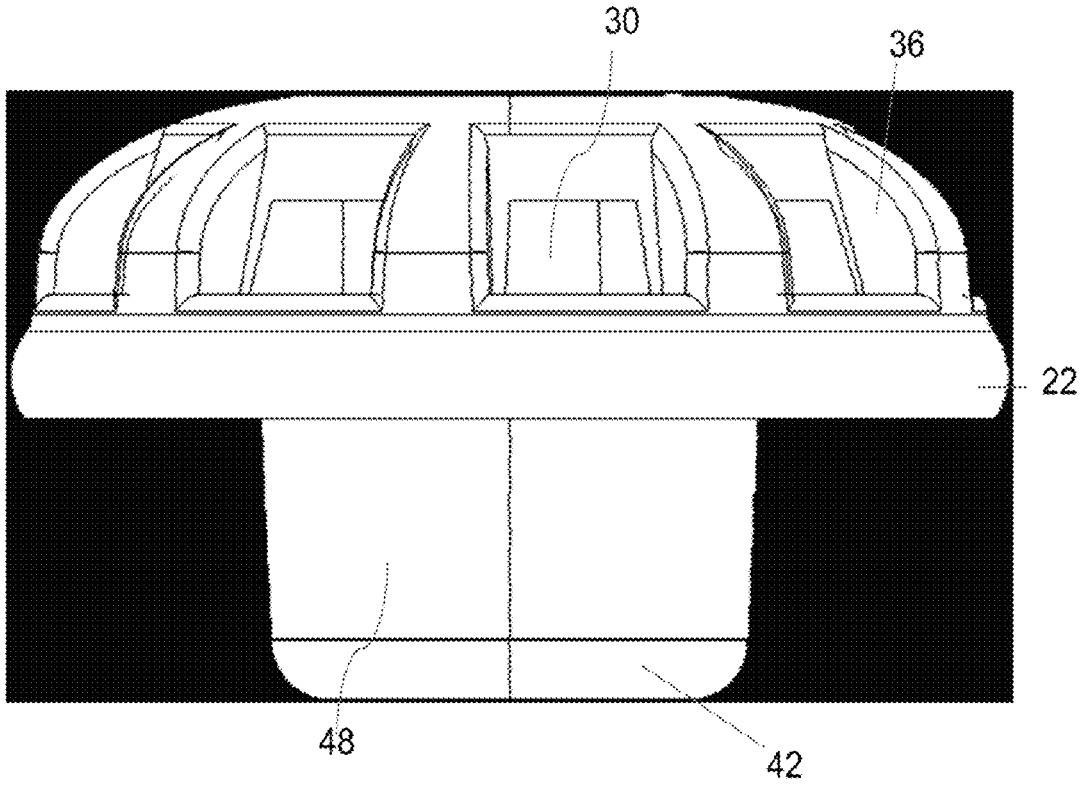
FIG. 5 is a side elevational view of the earwax filter.
Figure 6:
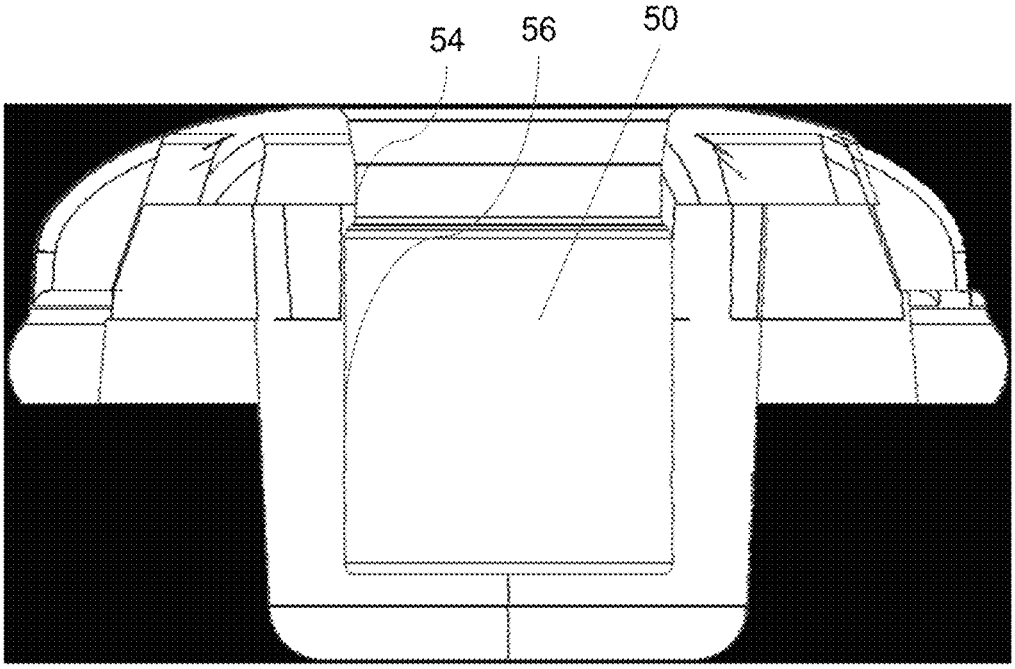
FIG. 6 is a cross-sectional view of the earwax filter alone.
Figure 7:
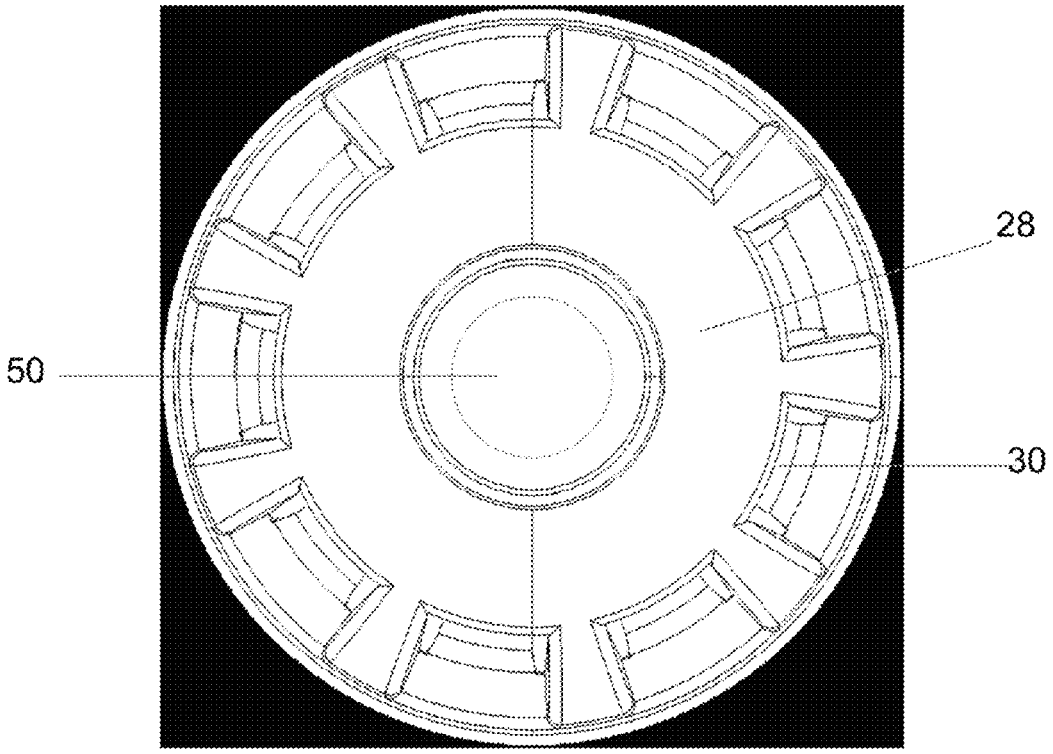
FIG. 7 is a top-plane view on the earwax filter.
Figure 8:
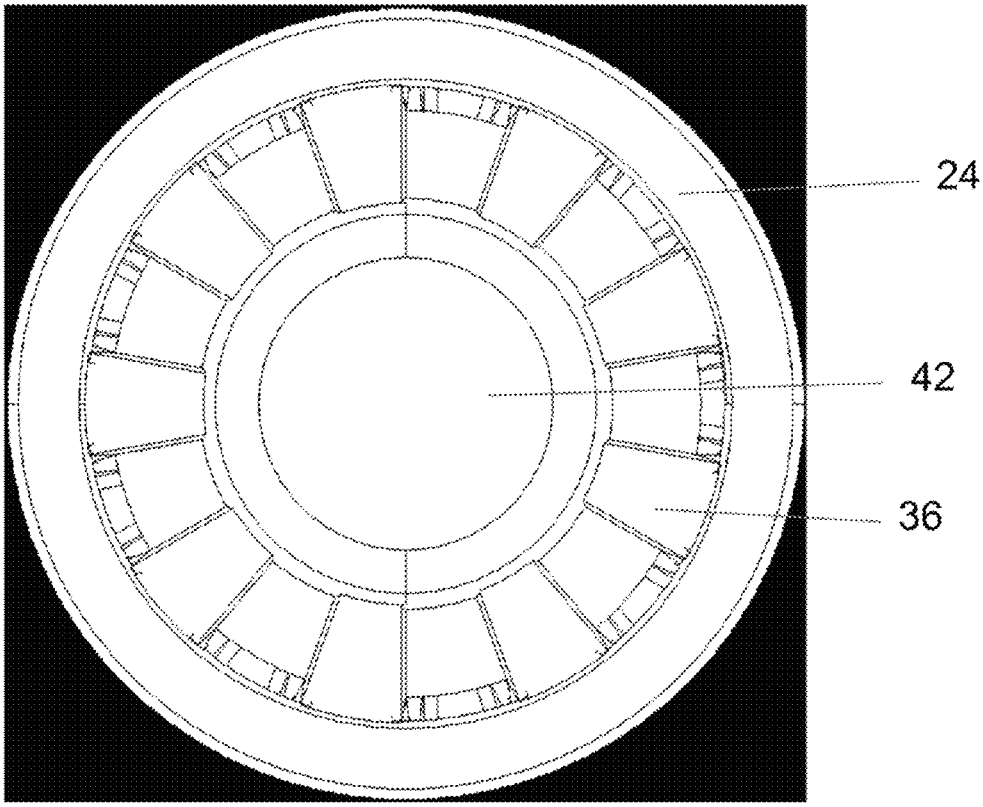
FIG. 8 is a bottom-plane view of the earwax filter.

Along a perimeter of the cap 28, sound inlets 30 are arranged that allow sound to enter into the sound inlet opening 10 through earwax filter 20. The diameter of the perimeter of the cap 28 along which the sound inlets 30 are arranged is smaller than the diameter of the peripheral edge 22 of the circumferential bead 26 and thus smaller than the diameter of the proximal (outer) sound inlet opening portion 12. The perimeter of the cap 28 along which the sound inlets 30 are arranged is indicated in FIG. 2 by a dash-dotted line.

A longitudinal extension of the circumferential bead 26 is smaller than a longitudinal extension of the proximal sound inlet opening portion 12—if measured along the longitudinal axis of sound inlet opening 10. Therefore, the circumferential bead 26 is recessed in the proximal sound inlet opening portion 12 and a groove 32 is created around the perimeter of the cap of the earwax filter.

The circumferential bead 26 has an inner circumferential wall 34 that extends in a direction transverse to the radially extending wall portion 16 of the sound inlet opening 10 and defines an at least nearly right angle between the radially extending wall portion 16 and the inner circumferential wall 34. This angle is an essential feature to keep earwax from creeping further into the sound inlet opening, because this sharp angle creates a capillary trap.

The circumferential bead 26 is connected to the cap 28 by axially and radially extending ribs 36. Each rib 36 is arranged between two neighboring sound inlets 30.

Each rib has an inner edge 38 facing the radially extending wall portion 16 of the sound inlet opening 10. The inner edge 38 of each rib 36 and the inner contact surface 24 of the circumferential bead 26 are offset with respect to each other so as to leave a gap 40 between each inner edge 38 of each rib 36 and the radially extending wall portion 16 of the sound inlet opening when the inner contact surface 24 of the circumferential bead 26 contacts the radially extending wall portion 16. This gap 40 causes a widening of the sound inlets 30 by way of some sort of undercut and further helps to prevent earwax from creeping into the sound inlet opening. Therefore, the gap 40 is not just a marginal gap.

The earwax filter 20 has a stem 42 that extends into the distal portion 14 of the sound inlet opening 10 while leaving an annular gap 44 between an inner circumferential wall 46 of the distal portion 14 and an outer circumferential wall 48 of the stem 42 thus defining a portion of a sound path along earwax filter 20. Due to the stepped shape of the sound inlet opening 10 and the shape of the earwax filter 20, a z-shaped sound path is defined that helps to prevent earwax from entering into sound inlet opening 10.

Figure 9:
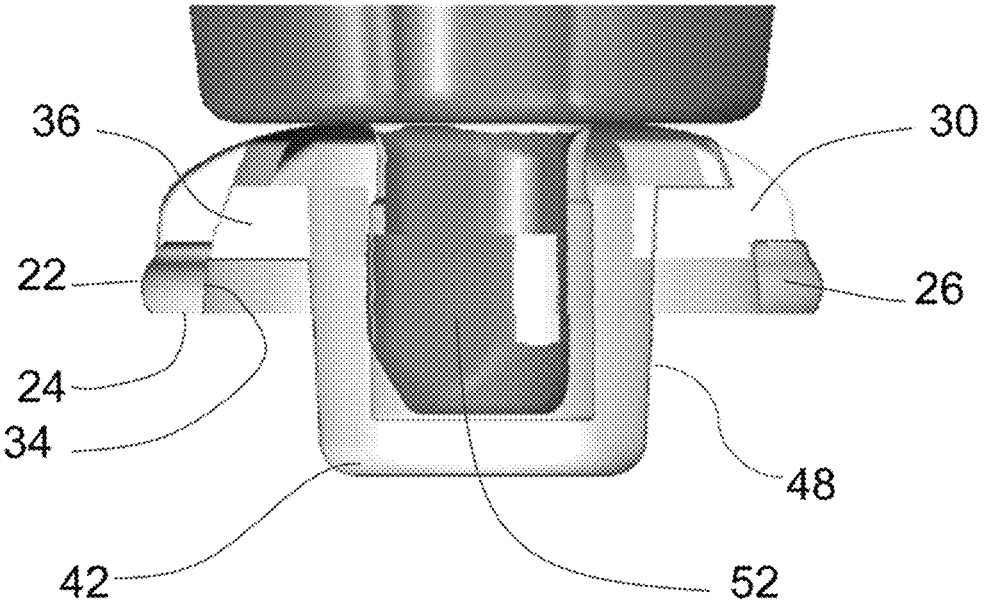
FIG. 9 is a partially cross-sectional representation of a tip of a handling tool interacting with the earwax filter.
Figure 10:
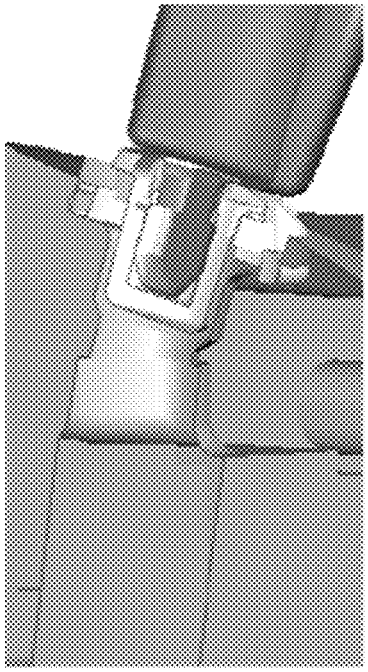
FIG. 10 is a partially cross-sectional view of a handling tool, an earwax filter and a sound inlet opening.
Figure 11:
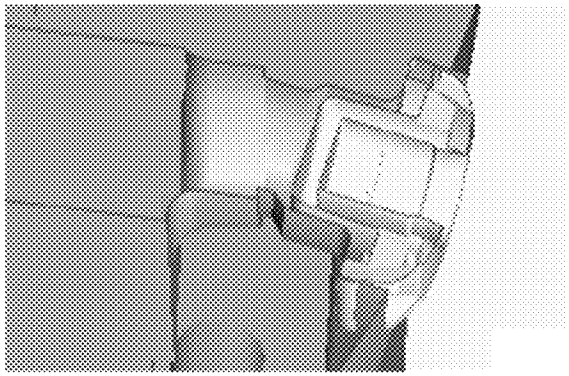
FIG. 11 is a partially cross-sectional view of a sound inlet opening and an earwax filter inserted therein.
Figure 12:
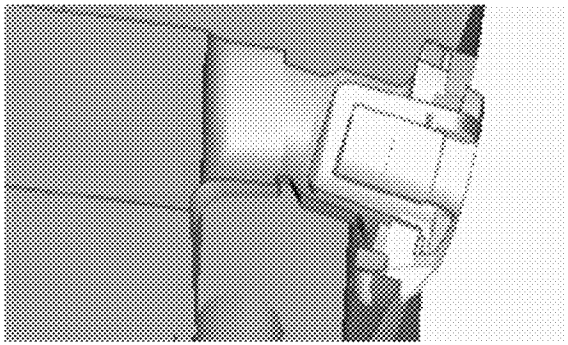
FIG. 12 is a further partially cross-sectional view of a sound inlet opening and an earwax filter inserted therein.

The stem 42 has a centrally arranged blind hole 50 that is open towards the outward facing side of the cap 28. The blind hole 50 is configured to receive a tip 52 (see FIG. 9) of a handling tool. Thus, the tip 52 of a handling tool can be inserted into the blind hole 50 for handling the earwax filter.

In order to prevent the earwax filter from falling off the handling tool during handling, a snap bead 54 is formed on the circumferential wall 56 of the blind hole which allows a snap-fit connection with the handling tool.

LIST OF REFERENCE NUMERALS

10 sound inlet opening
12 proximal portion
14 proximal distal (outer) portion
16 radially extending wall portion
18 circumferential wall
20 earwax filter
22 peripheral edge
24 inner contact surface
26 circumferential bead
28 cap
30 sound inlets
32 groove
34 inner circumferential wall of the circumferential bead
36 rib
38 inner edge
40 gap
42 stem
44 annular gap
46 inner circumferential wall
48 outer circumferential wall
50 blind hole
52 tip
54 snap bead
56 circumferential wall of the blind hole

The invention claimed is:

1. A hearing aid component with earwax filter, said hearing aid component comprising:

a sound inlet opening that has at least two sound inlet portions having different diameters and being displaced with respect to each other in a longitudinal direction of the sound inlet opening so that the sound inlet opening narrows towards the interior of the hearing aid component so that more proximal sound inlet portion has a relatively larger diameter and more distal sound inlet portion has a relatively smaller diameter; and said earwax filter placed in said sound inlet opening and including a cap with an outward-facing and an inward-facing side, said inward-facing side facing the hearing aid, when in use, and a peripheral edge, said peripheral edge being placed into the sound inlet portion with the relatively larger diameter, a stem protruding into the sound inlet portion with the relatively smaller diameter, said stem having a proximal end connected to the cap and a distal end, and said stem having a diameter that is smaller than the diameter of the sound inlet portion with the relatively smaller diameter so as to leave an annular gap between the stem and the sound inlet portion with the relatively smaller diameter, the annular gap being immediately adjacent to said cap and said stem, wherein the cap includes a plurality of sound inlets arranged along the periphery of the cap and being shaped so as to allow ambient sound passing into the annular gap, wherein the sound inlets are arranged along a perimeter of the cap.

2. The hearing aid component with earwax filter according to claim 1, wherein the peripheral edge is part of an outwardly facing circumferential bead surrounding the cap and having a diameter that is larger than the diameter of the perimeter along which the sound inlets are arranged.

3. The hearing aid component with earwax filter according to claim 2 wherein the circumferential bead is recessed in the sound inlet portion with the relatively larger diameter.

4. The hearing aid component with earwax filter according to claim 3, wherein the circumferential bead is connected to the cap by axially and radially extending ribs, each rib being arranged between two neighboring sound inlets.

5. The hearing aid component with earwax filter according to claim 3, wherein the circumferential bead has an inner contact surface for contacting a radially extending wall portion of the sound inlet opening that is present between the proximal sound inlet portion with the relatively larger diameter and the distal sound inlet portion with the relatively smaller diameter.

6. The hearing aid component with earwax filter according to claim 2 wherein the circumferential bead has an inner contact surface for contacting a radially extending wall portion of the sound inlet opening that is present between the proximal sound inlet portion with the relatively larger diameter and the distal sound inlet portion with the relatively smaller diameter.

7. The hearing aid component with earwax filter according to claim 6, wherein the circumferential bead has an inner circumferential wall that extends in direction transverse to the radially extending wall portion of the sound inlet opening that is present between the proximal sound inlet portion with the relatively larger diameter and the distal sound inlet portion with the relatively smaller diameter.

8. The hearing aid component with earwax filter according to claim 7, wherein the cap includes an undercut, and the inner circumferential wall of the circumferential bead defines an outer edge of said undercut.

9. The hearing aid component with earwax filter according to claim 7, wherein the circumferential bead is connected to the cap by axially and radially extending ribs, each rib being arranged between two neighboring sound inlets.

10. The hearing aid component with earwax filter according to claim 7, wherein the inner contact surface of the circumferential bead and an inner edge of each rib are offset with respect to each other so as to leave a gap between the inner edge of each rib and the radially extending wall portion of the sound inlet opening when the inner contact surface of the circumferential bead contacts the radially extending wall portion of the sound inlet opening, said gap being surrounded by the inner circumferential wall of the circumferential bead.

11. The hearing aid component with earwax filter according to claim 6, wherein the circumferential bead is connected to the cap by axially and radially extending ribs, each rib being arranged between two neighboring sound inlets.

12. The hearing aid component with earwax filter according to claim 6, wherein the inner contact surface of the circumferential bead and an inner edge of each rib are offset with respect to each other so as to leave a gap between the inner edge of each rib and the radially extending wall portion of the sound inlet opening when the inner contact surface of the circumferential bead contacts the radially extending wall portion of the sound inlet opening, said gap being surrounded by the inner circumferential wall of the circumferential bead.

13. The hearing aid component with earwax filter according to claim 12, wherein the earwax filter has between 5 and 11 ribs and sound inlets.

14. The hearing aid component with earwax filter according to claim 2, wherein the circumferential bead is connected to the cap by axially and radially extending ribs, each rib being arranged between two neighboring sound inlets.

15. The hearing aid component with earwax filter according to claim 14, wherein the earwax filter has between 5 and 11 ribs and sound inlets.

16. The hearing aid component with earwax filter according to claim 14, wherein the inner contact surface of the circumferential bead and an inner edge of each rib are offset with respect to each other so as to leave a gap between the inner edge of each rib and the radially extending wall portion of the sound inlet opening when the inner contact surface of the circumferential bead contacts the radially extending wall portion of the sound inlet opening, said gap being surrounded by the inner circumferential wall of the circumferential bead.

17. The hearing aid component with earwax filter according to claim 2, wherein the circumferential bead is connected to the cap by axially and radially extending ribs, each rib being arranged between two neighboring sound inlets.

18. The hearing aid component with earwax filter according to claim 2, wherein the stem has a blind hole that is open towards the outward-facing side of the cap and that is configured to receive a tip of a handling tool.

19. The hearing aid component with earwax filter according to claim 1, wherein the earwax filter has a hydrophobic coating.

20. The hearing aid component with earwax filter according to claim 1, wherein the cap includes an undercut, and the undercut surrounds said annular gap.

21. The hearing aid component with earwax filter according to claim 1, wherein each of the sound inlets fluidly communicates with said annular gap outside of the stem.

22. The hearing aid component with earwax filter according to claim 1, wherein the stem includes a blind hole that passes through the cap and is open towards the outward-facing side of the cap.

23. A hearing aid component with earwax filter, said hearing aid component having a sound inlet opening that has at least two sound inlet portions having different diameters and being displaced with respect to each other in a longitudinal direction of the sound inlet opening so that the sound inlet opening narrows towards the interior of the hearing aid component so that more proximal sound inlet portion has a relatively larger diameter and more distal sound inlet portion has a relatively smaller diameter, and said earwax filter being placed in said sound inlet opening and comprising:

a cap with an outward-facing and an inward-facing side, said in-ward-facing side facing the hearing aid, when in use, and a peripheral edge, said peripheral edge being placed into the sound inlet portion with the relatively larger diameter, a stem protruding into the sound inlet portion with the relatively smaller diameter, said stem having a proximal end connected to the cap and a distal end, and said stem having a diameter that is smaller than the diameter of the sound inlet portion with the relatively smaller diameter so as to leave an annular gap between the stem and the sound inlet portion with the relatively smaller diameter, wherein the cap has a plurality of sound inlets arranged along the periphery of the cap and being shaped so as to allow ambient sound passing into the annular gap, wherein the sound inlets are arranged along a perimeter of the cap, wherein the stem has a blind hole that is open towards the outward-facing side of the cap and that is configured to receive a tip of a handling tool.

24. The hearing aid component with earwax filter according to claim 23, wherein the blind hole has a snap bead that extends radially and inwardly into the blind hole to allow a snap-fit connection to a tip of a handling tool.

* * * * *